US007186317B2

(12) United States Patent
Beuther et al.

(10) Patent No.: US 7,186,317 B2
(45) Date of Patent: Mar. 6, 2007

(54) METHOD FOR PRODUCING SOFT BULKY TISSUE

(75) Inventors: Paul Beuther, Neenah, WI (US); Frank Druecke, Oshkosh, WI (US); Jeffrey Holz, Sherwood, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 621 days.

(21) Appl. No.: 10/735,287

(22) Filed: Dec. 12, 2003

(65) Prior Publication Data

US 2005/0126728 A1 Jun. 16, 2005

(51) Int. Cl.
*D21F 11/00* (2006.01)

(52) U.S. Cl. ..... 162/109; 162/205; 162/207; 162/117; 162/115

(58) Field of Classification Search ..... 162/109, 162/111–113, 115, 117, 204–207
See application file for complete search history.

(56) References Cited

U.S. PATENT DOCUMENTS

| | | | | |
|---|---|---|---|---|
| 3,262,841 | A * | 7/1966 | Embry | 162/301 |
| 3,301,746 | A * | 1/1967 | Sisson et al. | 162/113 |
| 3,432,936 | A * | 3/1969 | Greenhalgh et al. | 34/306 |
| 4,356,059 | A * | 10/1982 | Hostetler | 162/111 |
| 4,556,450 | A | 12/1985 | Chuang et al. | |
| 4,849,054 | A | 7/1989 | Klowak | |
| 5,411,636 | A | 5/1995 | Hermans et al. | |
| 5,492,598 | A * | 2/1996 | Hermans et al. | 162/113 |
| 5,510,002 | A * | 4/1996 | Hermans et al. | 162/113 |
| 6,083,346 | A * | 7/2000 | Hermans et al. | 162/115 |
| 6,103,062 | A | 8/2000 | Ampulski et al. | |
| 6,197,154 | B1 * | 3/2001 | Chen et al. | 162/109 |
| 6,287,426 | B1 | 9/2001 | Edwards et al. | |
| 6,340,413 | B1 * | 1/2002 | Nilsson et al. | 162/361 |
| 6,447,640 | B1 * | 9/2002 | Watson et al. | 162/101 |
| 6,547,924 | B2 | 4/2003 | Klerelid et al. | |
| 6,579,418 | B2 * | 6/2003 | Lindsay et al. | 162/198 |
| 6,881,375 | B2 * | 4/2005 | Topolkaraev et al. | 264/555 |
| 6,896,843 | B2 * | 5/2005 | Topolkaraev et al. | 264/555 |
| 2002/0117283 | A1 * | 8/2002 | Soderholm et al. | 162/203 |
| 2005/0087316 | A1 * | 4/2005 | Friedbauer et al. | 162/117 |
| 2005/0126728 | A1 * | 6/2005 | Beuther et al. | 162/109 |
| 2006/0130985 | A1 * | 6/2006 | Beuther et al. | 162/111 |

* cited by examiner

*Primary Examiner*—José A. Fortuna
(74) *Attorney, Agent, or Firm*—Dority & Manning, P.A.

(57) ABSTRACT

A process for producing tissue webs is disclosed. The process includes the step of partially dewatering a tissue web and then subjecting the web to multiple deflections against fabrics prior to drying the tissue web. For instance, in one embodiment, the tissue web is deflected multiple times in between two opposing fabrics. The tissue web can be deflected against the fabrics under sufficient pressure to cause the tissue web to mold against the fabrics. By deflecting the tissue web multiple times, rearrangement of the papermaking fibers contained in the tissue web occurs increasing the bulk of the web.

14 Claims, 6 Drawing Sheets

METHOD FOR PRODUCING SOFT BULKY TISSUE

BACKGROUND OF THE INVENTION

Many tissue products, such as facial tissue, bath tissue, paper towels, industrial wipers, and the like, are produced according to a wet laid process. Wet laid webs are made by depositing an aqueous suspension of pulp fibers onto a forming fabric and then removing water from the newly-formed web. Water is typically removed from the web by mechanically pressing water out of the web which is referred to as "wet-pressing". Although wet-pressing is an effective dewatering process, during the process the tissue web is compressed causing a marked reduction in the caliper of the web and in the bulk of the web.

For most applications, however, it is desirable to provide the final product with as much bulk as possible without compromising other product attributes. Thus, those skilled in the art have devised various processes and techniques in order to increase the bulk of wet laid webs. For example, creping is often used to disrupt paper bonds and increase the bulk of tissue webs. During a creping process, a tissue web is adhered to a heated cylinder and then creped from the cylinder using a creping blade.

Another process used to increase web bulk is known as "rush transfer". During a rush transfer process, a web is transferred from a first moving fabric to a second moving fabric in which the second fabric is moving at a slower speed than the first fabric. Rush transfer processes increase the bulk, caliper and softness of the tissue web.

As an alternative to wet-pressing processes, through-drying processes have developed in which web compression is avoided as much as possible in order to preserve and enhance the bulk of the web. These processes provide for supporting the web on a coarse mesh fabric while heated air is passed through the web to remove moisture and dry the web.

Although through-dried tissue products exhibit good bulk and softness properties, through-drying tissue machines are expensive to build and operate. Accordingly, a need exists for producing higher quality tissue products by modifying existing, conventional, wet-pressing tissue machines.

In this regard, U.S. Pat. No. 5,411,636 to Hermans, et al., which is incorporated herein by reference, discloses a process for improving the internal bulk of a tissue web by subjecting the tissue web to differential pressure while supported on a coarse fabric at a consistency of about 30% or greater. The processes disclosed in the '636 patent provide various advantages in the art of tissue making, without having to completely dry a web using a through-air dryer.

Additional improvements in the art, however, are still needed. In particular, a need currently exists for an improved process that reorients fibers in a tissue web for increasing the bulk and softness of the web without having to subject the web to a rush transfer process or to a creping process. A need also exists for a process that increases the bulk and softness of a web without significantly adversely affecting other properties of the web.

SUMMARY OF THE INVENTION

The present invention is generally directed to further improvements in the art of tissue making. Through the processes and methods of the present invention, the properties of a tissue web, such as the bulk of the web, may be improved. The methods and processes of the present invention may incorporate various conventional techniques or may be used to replace conventional techniques. For example, the process of the present invention may be used as a replacement to a rush transfer process or a through-drying process, or may be used in conjunction with rush transfer or a through-air dryer.

In one embodiment, the process for producing a tissue web in accordance with the present invention may include the steps of first depositing an aqueous suspension of papermaking fibers onto a forming fabric to form a wet web. The wet web is dewatered to a consistency of about 30% to about 65%, such as from about 40% to about 60%.

According to the present invention, the tissue web is deflected multiple times in between opposing transfer fabrics such that the web is biased against the opposing fabrics at least three different times. During the multiple deflections, the fibers within the web become rearranged, increasing the bulk of the web. For example, in one embodiment, the tissue web is molded against the fabrics, meaning that fiber rearrangement occurs such that the web assumes the typography of the fabrics. Molding the tissue web onto one fabric and then molding the web in the reverse direction onto a different fabric in a partially dry state provides significant fiber disruption sufficient to improve the properties of the web.

After being deflected multiple times, the tissue web is then dried to a final dryness.

The multiple deflections of the present invention may occur, in one embodiment, in between a first fabric and a second fabric. In this embodiment, for instance, a first side of the web may be biased against the first fabric and then the second side of the web may be biased against the second fabric. After the second side of the web is biased against the second fabric, the first side of the web may be once again biased against the first fabric. In other embodiments, however, three fabrics may be used in order to carry out the multiple deflections. Further, it should be understood that greater than three deflections may occur during the process.

In one embodiment, the dewatered tissue web is deflected multiple times using pneumatic pressure. For instance, web transfers can be carried out using gas emitting devices that emit a gas at a pressure sufficient to push the web from one transfer fabric to an opposing transfer fabric. Alternatively, or in addition to using a gas emitting device, a suction device may be used that pulls a web from one transfer fabric to an opposing deposing fabric. Gas pressures of such devices can be at least, for instance, 5 inches of Hg, such as from about 10 inches Hg to about 60 inches Hg and particularly, from about 10 inches Hg to about 20 inches Hg.

Tissue webs made according to the present invention can have a bulk of at least 10 cc/g, such as at least 15 cc/g prior to being wound into a roll. Although the process of the present invention can be used to form any tissue web, the process, in one embodiment, is configured to produce facial tissues and bath tissues having a basis weight of from about 6 gsm to about 45 gsm. In other embodiments, the process may be used to form wiping products, such as paper towels, having a basis weight of greater than about 30 gsm, such as from about 30 gsm to about 120 gsm.

In order to dry the web to a final dryness, in one embodiment, the web may be adhered to a heated drying cylinder and then creped from the cylinder. For example, in one embodiment, an adhesive may be used to adhere the web to the drying cylinder.

In order to dewater the web, the tissue web may be fed, in one embodiment, through a nip defined by a pair of opposing press rolls. In an alternative embodiment, however, a through-air dryer may be used in order to dewater the web to a desired consistency.

In one particular embodiment of the present invention, the multiple deflections are carried out on a deflection roll. The deflection roll may include at least one gas emitting zone and at least one gas receiving zone. The tissue web is conveyed around the deflection roll while sandwiched between two transfer fabrics. The wrap of the fabrics around the deflection roll is such that the web passes over the gas emitting zone and the gas receiving zone. For instance, in one embodiment, the fabrics are wrapped around the deflection roll at least 30 degrees.

When passing over the gas emitting zone, a gas is emitted from the deflection roll that deflects the web from one transfer fabric to an opposing fabric. Similarly, when the web is passed over the gas receiving zone, the web is transferred from one of the transfer fabrics to an opposing transfer fabric.

In order to provide gas flow into and out of the deflection roll, the deflection roll can be placed in communication with a vacuum source and/or a pressurized gas source. In one particular embodiment, a hood is placed over the deflection roll. A pressurized gas source emits a gas through the gas emitting zone. The hood is in communication with the gas emitting zone and is configured to redirect the gas flow from the gas emitting zone and into the gas receiving zone of the roll. Similarly, the hood may also be configured to direct a gas flow created by a vacuum source.

In one embodiment, the deflection roll includes at least two gas emitting zones. The gas receiving zone is positioned in between the two gas emitting zones. In an alternative embodiment, the deflection roll includes at least two gas receiving zones, wherein the gas emitting zone is positioned in between the two gas receiving zones.

Other features and aspects of the present invention are discussed in greater detail below.

BRIEF DESCRIPTION OF THE DRAWINGS

The following is a detailed description of the present invention including reference to the following figures in which.

Figure 1:
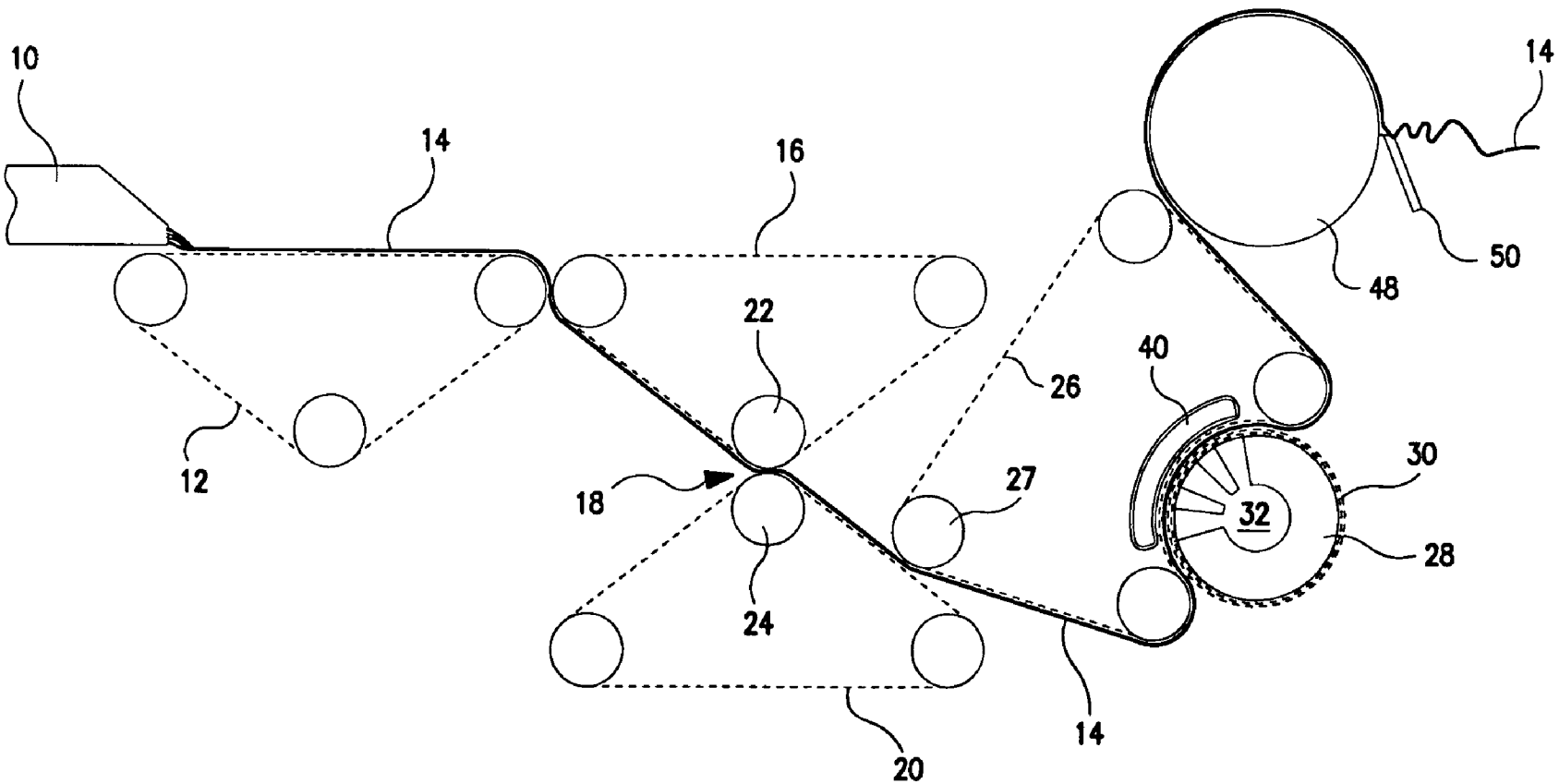
FIG. 1 is a side view of one embodiment of a process made in accordance with the present invention.

Repeat use of reference characters in the present specification and drawings is intended to represent the same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary constructions.

In general, the present invention is directed to the formation of tissue webs having good bulk and softness properties while maintaining adequate strength properties. In general, the tissue webs are made by deflecting a partially dried web made from papermaking fibers multiple times. For instance, in one embodiment, the partially dried tissue web is deflected at least three times in between a first fabric and a second fabric. For example, in one embodiment, the web can be biased against opposing fabrics at least four times, such as at least five times.

As used herein, the term "deflection" refers to a process in which a tissue web is biased against an opposing surface with a force sufficient to cause at least some of the fibers in the web to reorient. In some embodiments, the force may be sufficient to cause the web to mold and conform to the topography of the surface.

In one embodiment, the multiple fabric deflections may be carried out using pneumatic pressure. For example, suction or vacuum devices and/or pressure devices may be used for deflecting the tissue web from one fabric to another. In one particular embodiment of the present invention, a deflection roll may be used that includes a fabric sleeve and alternating gas emitting zones and gas receiving zones.

Referring to FIG. 1, one embodiment of a tissue making process in accordance with the present invention is shown. As illustrated, the system includes a head box 10 which deposits an aqueous suspension of papermaking fibers onto a forming fabric 12. The papermaking fibers can include, but are not limited to, all known cellulosic fibers or fiber mixes comprising cellulosic fibers. The fibers can include, for example, hardwood fibers such as eucalyptus fibers or softwood fibers, such as northern softwood kraft fibers. Other fibers may include high-yield fibers, recycled fibers, broke, synthetic cellulosic fibers, and the like.

Once the aqueous suspension of fibers is deposited onto the forming fabric 12, some of the water contained in the aqueous suspension is drained through the fabric and a tissue web 14 is formed. The wet web 14 retained on the surface of the forming fabric has a consistency of about 10%.

As shown in FIG. 1, the wet tissue web 14 is transferred to a first transfer fabric 16 which may be, for instance, a papermaking felt. In accordance with the present invention, the tissue web 14 is then fed into a press nip 18 and further dewatered. The press nip 18 is formed between the first transfer fabric 16 and a second transfer fabric 20 utilizing a first press roll 22 and a second press roll 24. The press nip further dewaters the tissue web 14 to a consistency of about 30% or greater, such as from about 30% to about 65%. In one particular embodiment, for example, the tissue web is dewatered in the nip 18 to a consistency of about 40% to about 60%.

In FIG. 1, a press nip is shown formed between a pair of opposing press rolls. In other embodiments, multiple press nips may be used in order to dewater the web. Further, instead of or in addition to press nips, shoe-type presses may also be used to dewater the web. In further embodiments, a through-air dryer may be used in order to dewater the web.

From the nip 18 the tissue web 14 is conveyed on the second transfer fabric 20 and then transferred to a third transfer fabric 26. If needed, a vacuum roll 27 or other suitable transfer device may be used in order to guide the web onto the third transfer fabric 26.

While carried on the third transfer fabric 26, the tissue web 14 is passed over a deflection roll 28. One embodiment of a deflection roll is more particularly shown in FIG. 2. As illustrated, the deflection roll 28 includes a fabric sleeve 30 that surrounds the roll. The tissue web 14 is passed around the deflection roll 28 in between the third transfer fabric 26 and the fabric sleeve 30. For many applications, the tissue web 14 and the third transfer fabric 26 have a wrap around the deflection roll 28 of at least about 30 degrees.

The deflection roll 28 is porous and air permeable to allow the flow of air through the roll. For example, in one embodiment, the deflection roll can be made from metal in a honeycomb-like configuration. In this embodiment, the deflection roll has a particular thickness to allow for support of the channels running through the honeycomb pattern. In other embodiments, however, other various porous arrangements may be used in constructing the deflection roll.

Figure 2:
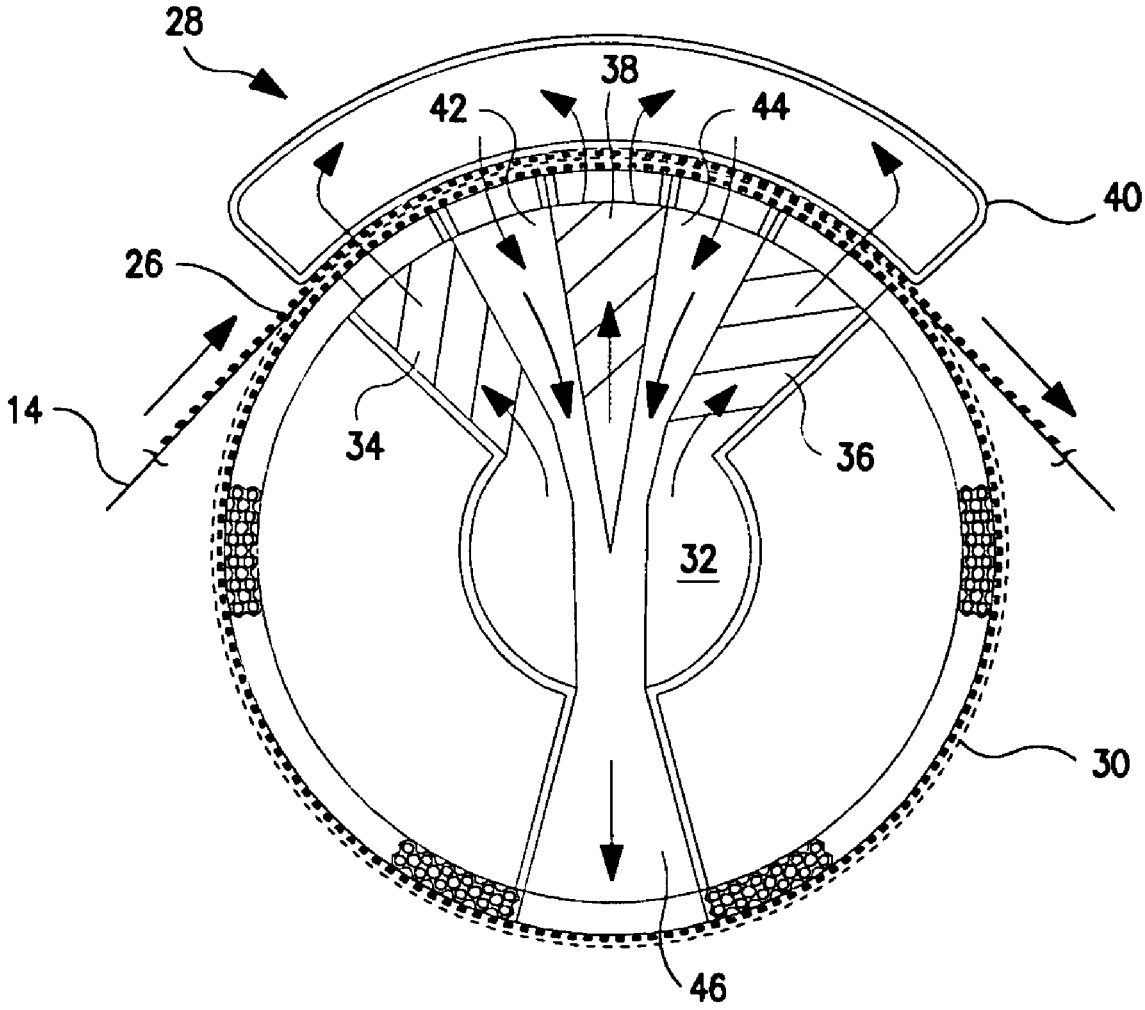
FIG. 2 is a side view of one embodiment of a deflection roll made in accordance with the present invention.

As shown in FIG. 2, the deflection roll 28 includes a center area 32 that is in fluid communication with a plurality of gas emitting zones 34, 36 and 38. The deflection roll 28 further includes a hood 40 that surrounds the gas emitting zones. Not shown, the hood 40 may include seals that adequately seal the hood to the deflection roll against the outside atmosphere. The hood 40 is in fluid communication with a plurality of gas receiving zones 42 and 44. The deflection roll 28 further includes a gas exhaust 46.

In the embodiment shown in FIG. 2, a pressurized gas source (not shown), such as a fan or a blower, flows a pressurized gas such as air or a heated gas into each of the gas emitting zones 34, 36 and 38. The gas flows to the gas emitting zones, through the fabric sleeve 30, through the third transfer fabric 26, and into the hood 40. The hood 40 is then configured to redirect the gas back into the gas receiving zones 42 and 44. Gas is then exhausted through the gas exhaust 46.

In this manner, the tissue web 14 passes over multiple and alternating gas emitting zones and gas receiving zones. When passing over the gas emitting zone 34, the tissue web 14 is deflected against the third transfer fabric 26. When passing over the gas receiving zone 42, on the other hand, the tissue web 14 is deflected against the fabric sleeve. Next, the tissue web 14 passes over the gas emitting zone 38 and is deflected against the transfer fabric 26, then deflected against the fabric sleeve 30 after passing over the gas receiving zone 44. Finally, when passing over the gas emitting zone 36, the tissue web 14 is once again deflected against the transfer fabric 26.

In this manner, the tissue web 14 is deflected five times. It should be understood, however, that the deflection roll 28 may include more or less gas emitting zones and more or less gas receiving zones. For instance, in one embodiment, the deflection roll 28 includes a single gas emitting zone and a single gas receiving zone.

In the embodiment illustrated in FIG. 2, the pressurized gas source is used in order to convey a fluid such as air through the deflection roll 28. In other embodiments, however, various other gas flow configurations are possible. For example, in an alternative embodiment, the center area 32 may be placed in communication with a suction device or a vacuum source for creating air flow within the gas receiving zones 42 and 44. The gas flow through the gas receiving zones may then be redirected into the gas emitting zones.

In still another embodiment, the deflection device 28 can be placed in communication with one or more pressurized gas sources for feeding a pressurized gas into the gas emitting zones and may be placed in communication with one or more suction devices for creating a suction force within each of the gas receiving zones.

The amount of pneumatic pressure that is generated within each of the zones may vary depending upon the particular application. Further, the pressure from zone to zone may vary as well. In general, gas pressures within the zones can be at least 1 inch Hg, at least 2 inches Hg, such as at least 4 inches Hg. The pressures may vary, for instance, from about 1 inch Hg to about 60 inches Hg, such as from about 4 inches Hg to about 20 inches Hg.

The particular amount of pressure needed in each of the zones may be dependent upon the amount of deflection of the web that is desired. For example, in one embodiment, pressures may be used that are sufficient to cause the tissue web to mold against the transfer fabric and/or the fabric sleeve. When molding occurs, fibers within the tissue web are rearranged causing the web to form a reverse impression of the fabric that the web is deflected against. The present inventors believe that the rearrangement of fibers caused by deflection against both sides of the web in a partially dry state provides significant disruption of the fiber bonds to create improved bulk and softness characteristics.

The fabrics that are used in the processes of the present invention for deflecting the tissue web may vary depending upon the particular circumstances. In one embodiment, for instance, coarse fabrics may be used for either assisting in fiber bond disruption during deflection or for simply creating a more aesthetically appealing product.

Referring back to FIG. 1, from the deflection roll 28, the tissue web 14 is carried on the third transfer fabric 26 to a drying cylinder 48. The drying cylinder 48 may be, for instance, a Yankee dryer.

In one embodiment, an adhesive may be applied to the tissue web or to the dryer for adhering the web to the dryer. The adhesive may be, for instance, any suitable or conventionally used adhesive. For instance, in one embodiment, an adhesive containing polyvinyl alcohol may be used. The adhesive may be, for instance, sprayed onto the web. As shown in FIG. 1, once adhered to the drying cylinder 48, the tissue web 14 is creped from the cylinder using a creping blade 50. Creping the web serves to further cause fiber disruption and increase the bulk of the web. Once creped, the tissue web is wound onto a reel for converting and later packaging.

Although the process in FIG. 1 shows the use of a drying cylinder and creping blade, it should be understood that any suitable drying device may be used in the present invention. For example, in other embodiments, the process may include a through-air dryer.

The process of the present invention is particularly well suited to producing all different types of tissue products. The tissue products can have, for instance, a basis weight of from about 6 gsm to about 120 gsm. Tissue products that may be produced according to the present invention include paper towels, industrial wipers, and various products.

In one particular embodiment of the present invention, the process is used to produce facial tissue or bath tissue. The facial tissue webs or bath tissue webs can have a basis weight, for instance, of from about 6 gsm to about 45 gsm, such as from about 10 gsm to about 15 gsm. The final product can contain a single ply or can contain multiple plies (2 to 3 plies).

As described above, tissue products made according to the present invention have improved softness and bulk properties, while maintaining adequate strength and stiffness properties. In fact, tissue webs made according to the present invention can have a bulk prior to being wound into a parent roll of at least about 15 cc/g, such as from about 15 cc/g to about 20 cc/g. Further, the above bulk properties may be obtained without ever through-drying the web. The above bulk properties can also be achieved without having to subject the tissue web to a rush transfer process. In fact, the process of the present invention utilizing multiple deflections may be used to replace a rush transfer operation altogether.

During converting, the tissue web is typically calendered and packaged. After calendering, the tissue web may have a bulk of greater than about 7.5 cc/g, such as greater than about 8 cc/g. For example, in one embodiment, after being calendered, the tissue web may have a bulk of from about 8 cc/g to about 13 cc/g, such as from about 9 cc/g to about 11 cc/g.

In FIG. 1, multiple deflections of the partially dried tissue web occur along the surface of the deflection roll 28. In other embodiments, other devices may be used in order to carry out the multiple deflections. For example, referring to FIG. 5, the tissue web 14 is shown in between a first transfer fabric 52 and a second transfer fabric 54. In this embodiment, the tissue web 14 is carried on the first transfer fabric 52 and then deflected against the second transfer 54 using a suction device 56. The suction device can be, for instance, a vacuum box, a vacuum shoe, or a vacuum roll.

As shown, once the web 14 passes over the suction device 56, the web is deflected back against the first transfer fabric 52 using a second suction device 58. Next, the tissue web is deflected against the second transfer fabric 54 by a third suction device 60. In this manner, the web is deflected three times. In other embodiments, however, further suction devices may be included for carrying out further deflections.

Figure 5:
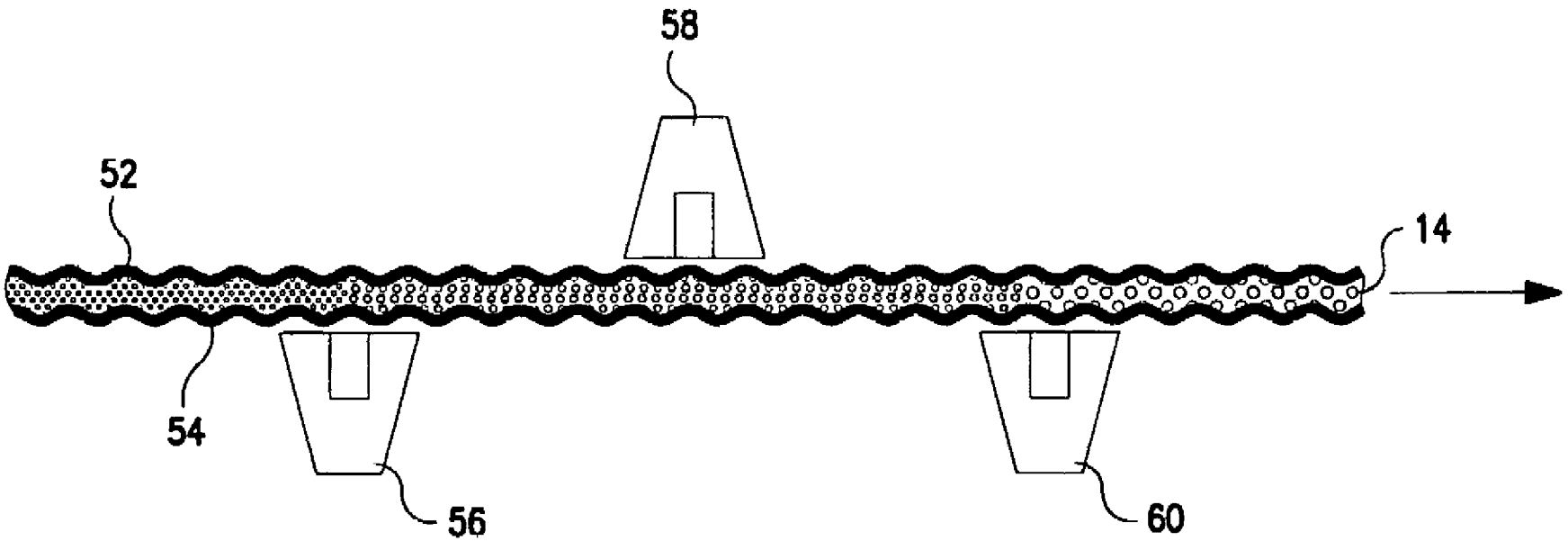
FIG. 5 is a partial side view showing another method for deflecting a tissue web multiple times in between a pair of transfer fabrics.

The arrangement shown in FIG. 5 may be used to replace the deflection roll 28 as shown in FIG. 1. An additional transfer fabric and the suction devices, for instance, may be placed where the deflection roll is located.

In the embodiments shown in FIG. 5, suction devices 56, 58 and 60 accomplish the multiple deflections. In other embodiments, however, it should be understood that in addition or instead of suction devices, various pressurized devices may be used that instead of pulling a tissue web onto a fabric, push a web against a fabric. The pressurized devices may include, for instance, a pressurized shoe or a pressurized roll that emits a fluid, such as air, against the tissue web. The pressurized device may be used to replace the suction devices shown in FIG. 5 or may be used in conjunction with the suction devices. For instance, a pressurized device may be placed downstream of such a device or may be placed opposite a suction device for either carrying out a deflection on its own or carrying out a deflection in conjunction with the suction device.

In the embodiments shown in FIG. 5, only two opposing transfer fabrics 52 and 54 are shown. It should be understood, however, that further fabrics may be used if desired. For instance, each deflection may be carried out against a different fabric. The fabrics may have the same or different topographies.

In FIG. 5, the tissue web 14 is also shown in continuous contact with fabrics 52 and 54 during the multiple deflections. It should also be understood, however, that in other embodiments, the tissue web 14 may actually transfer from one transfer fabric to the other transfer fabric during the deflections. In fact, fabric transfers can also occur when using the deflection roll as shown in FIG. 1. Actual web transfers are not needed, however, in order to reorient the fibers of the web in accordance with the present invention.

Figure 3:
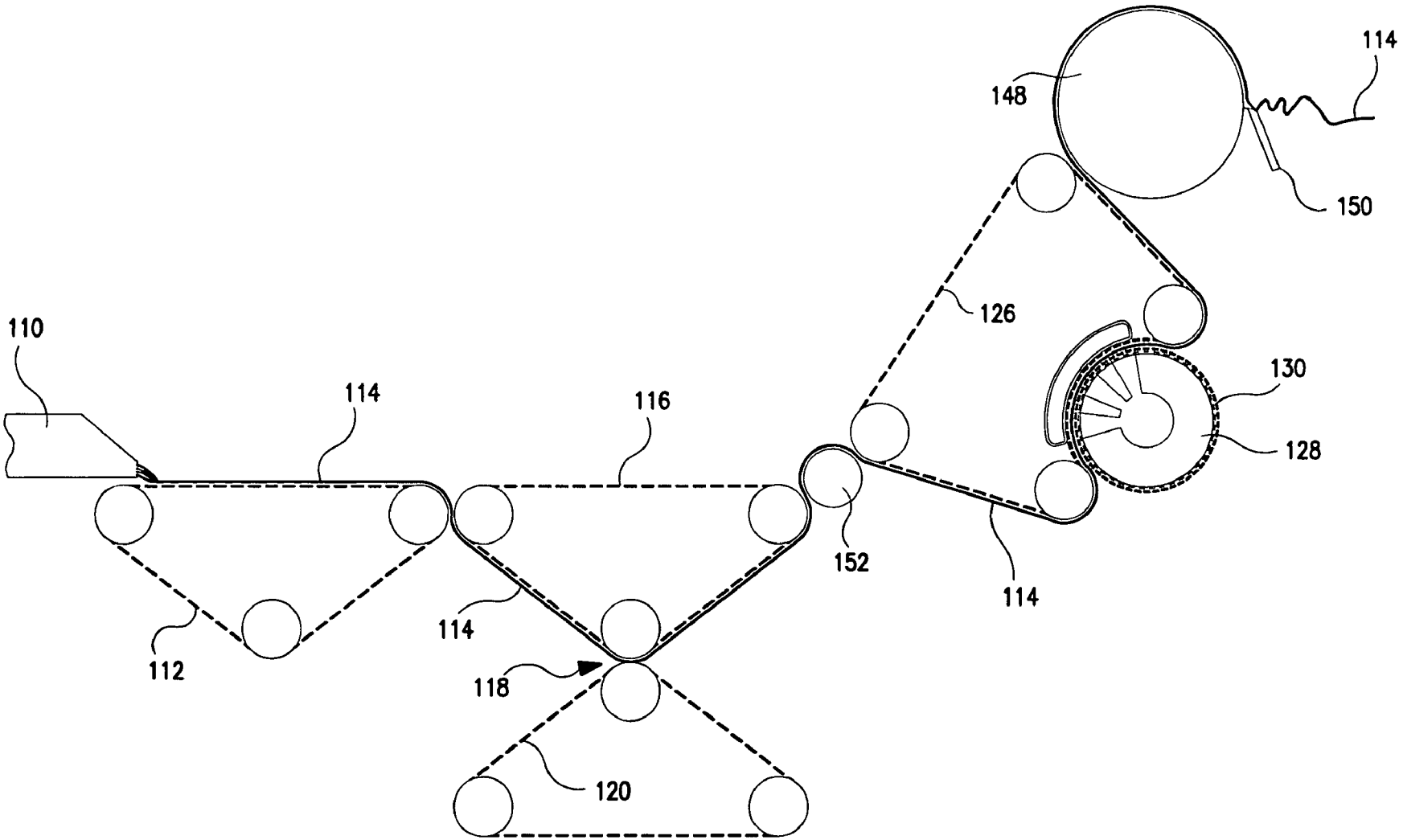
FIG. 3 is a side view of another embodiment of a process made in accordance with the present invention.
Figure 4:
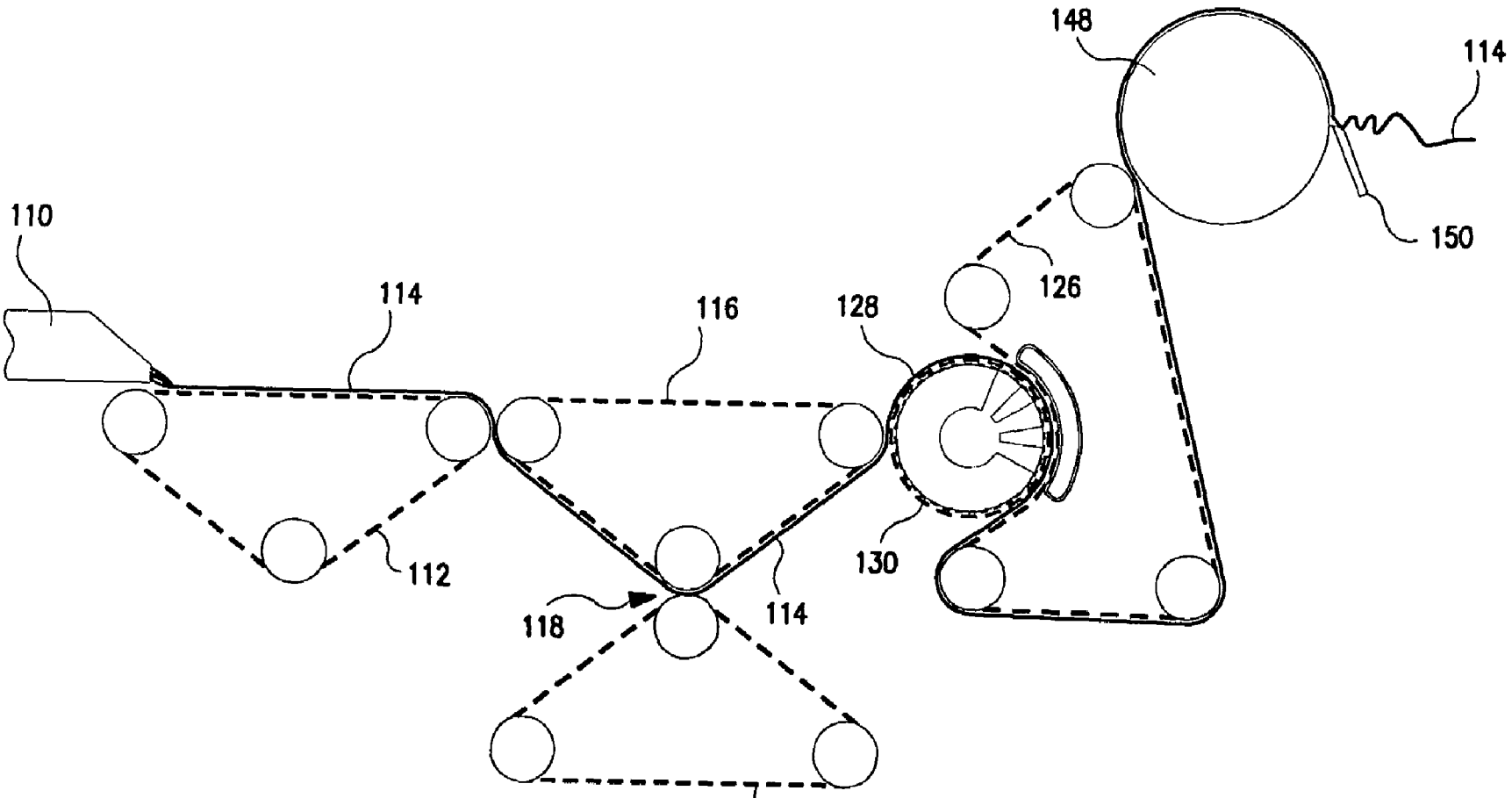
FIG. 4 is a side view of still another embodiment of a process made in accordance with the present invention.
Figure 6:
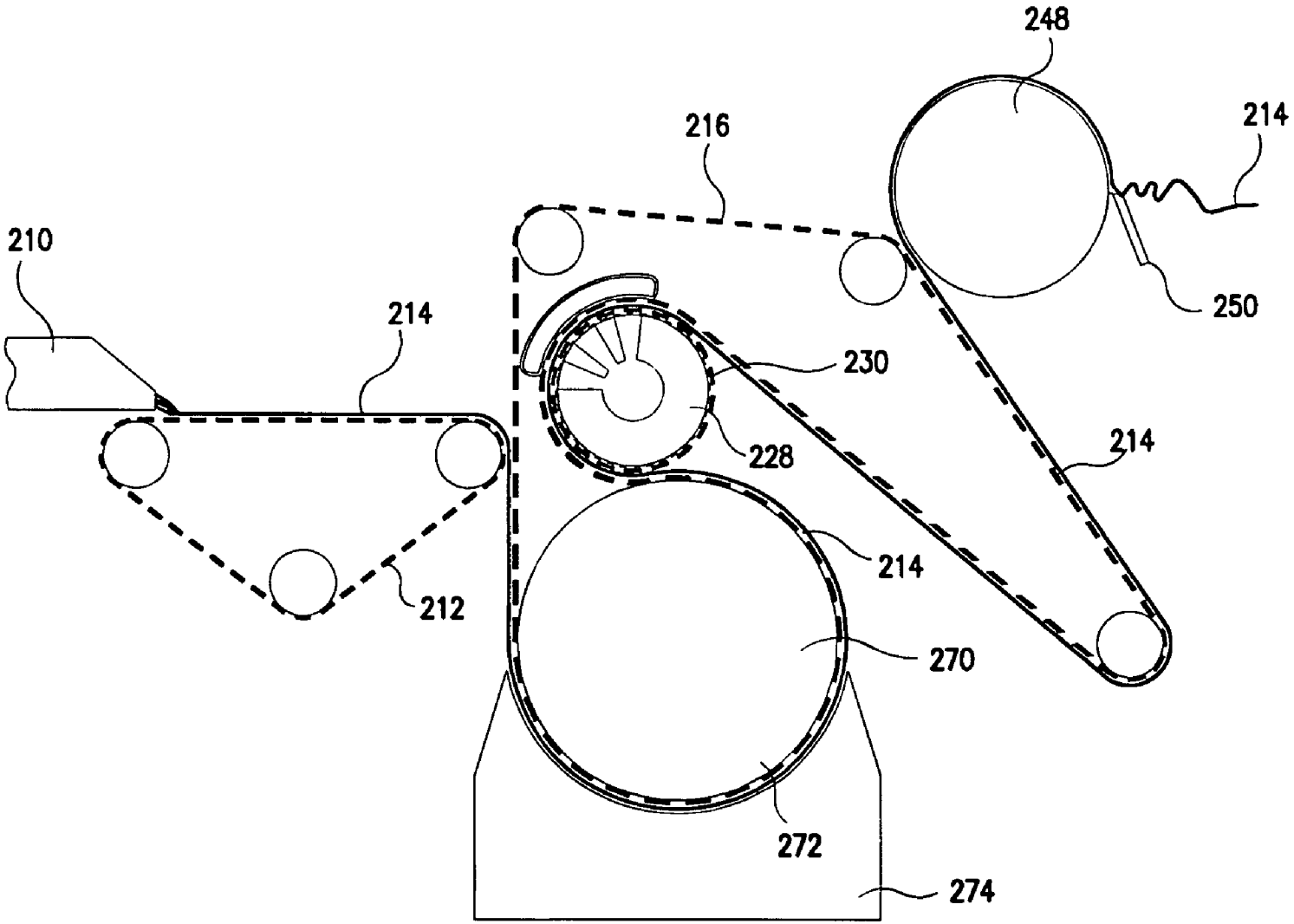
FIG. 6 is a side view of another embodiment of a process made in accordance with the present invention.

Referring to FIGS. 3, 4 and 6, other processes in accordance with the present invention are illustrated. For example, referring to FIG. 3, a process similar to the process illustrated in FIG. 1 is shown. As illustrated, a head box 110 emits an aqueous slurry of papermaking fibers onto a forming fabric 112 for forming a wet tissue web 114. From the forming fabric 112, the tissue web is transferred to a first transfer fabric 116 and fed into a press nip 118 for partially dewatering the web to a consistency of from about 30% to about 70%. In this embodiment, instead of being transferred to a second transfer fabric 120, the tissue web 114 remains on the first transfer fabric 116 when exiting the nip 118. From the first transfer fabric 116, the web is then transferred to a third transfer fabric 126 and fed through a deflection roll 128.

In accordance with the present invention, while passing over the deflection roll, the tissue web is deflected multiple times between the third transfer fabric 126 and a fabric sleeve 130. The deflection roll 128 includes at least one gas emitting zone and at least one gas receiving zone for deflecting a web.

From the deflection roll 128, the tissue web 114 is adhered to a drying cylinder 148 and creped from the cylinder using a creping blade 150.

In the embodiment illustrated in FIG. 3, a transfer roll 152 is present for assisting in the transfer of the web from the first transfer fabric 116 to the third transfer fabric 126.

Referring to FIG. 4, a similar process to the one shown in FIG. 3 is illustrated. Like reference numerals have been included to represent similar elements or features. As shown, in the embodiment illustrated in FIG. 4, the transfer roll 152 has been eliminated and the tissue web 114 is transferred directly to the deflection roll 128 from the first transfer fabric 116. In the process shown in FIG. 4, the tissue web 114 is dewatered to a consistency of from about 30% to about 65% and then deflected multiple times in between a third transfer fabric 126 and a fabric sleeve 130 wrapped around the deflection roll 128. Once deflected multiple times, the tissue web 114 is then dried to a final dryness using a drying cylinder 148. The web is also adhered to the drying cylinder and creped from the cylinder using a creping blade 150.

One of the advantages to the present invention is that conventional papermaking lines may be easily modified into a process in accordance with the present invention. For instance, as shown in the processes illustrated in FIGS. 1, 3 and 4, a press nip is used to dewater the tissue web and a deflection roll is used to deflect the partially dried web multiple times. These elements may be easily incorporated into most existing processing lines. By conforming a conventional process line to the teachings of the present invention, tissue webs may be produced having improved properties.

In fact, tissue webs made according to the present invention may have properties very comparable to through-air dried webs without having to incorporate a through-air dryer into the system. For instance, through-air dryers are relatively expensive to manufacture and operate. Further, paper processing lines typically need to be entirely reworked when attempting to incorporate a through-dryer into the system.

It should be understood, however, that a through-air dryer may be used in a process of the present invention. For instance, in one embodiment, as described above, a through-air dryer may be used to partially dry a web prior to the web being deflected multiple times. For example, referring to FIG. 6, a process is shown in which a head box 210 deposits an aqueous suspension of papermaking fibers onto a forming fabric 212 to form a wet tissue web 214. The wet tissue web is transferred from the forming fabric 212 to a through-drying fabric 216.

Once transferred to the through-drying fabric 216, the tissue web 214 is fed into a through-air dryer 270. The through-air dryer 270 includes a drying cylinder 272 and a hood 274. In order to partially dry the tissue web 214, heated air flows either from the hood 274 into the drying cylinder 272 or flows from the drying cylinder 272 into the hood 274.

Once the tissue web 214 is dried to a consistency of about 30% to about 70%, the tissue web is then fed to a deflection roll 228 located along the through-drying fabric 216. The tissue web is fed in between the through-drying fabric 216 and a fabric sleeve 230. As the web travels along the deflection roll, the web is deflected multiple times. Next, the tissue web 214 is adhered to a drying cylinder 248 and creped using a creping blade 250.

The present invention may be better understood with reference to the following example.

EXAMPLE

The following example was performed in order to demonstrate the effect multiple deflections have on a semi-dry tissue web.

During this example, the following tests were performed on various samples:

Geometric mean tensile strength (GMT) is the square root of the product of the machine direction tensile strength and the cross-machine direction tensile strength of the web (in Nm/g). As used herein, tensile strength refers to mean tensile strength as would be apparent to one skilled on the art (in Nm/g). Geometric tensile strengths are measured using a MTS Synergy tensile tester using a 1 inch sample width, a jaw span of 2 inches was used for machine direction tests and 3 inches for cross machine direction tests, and a cross-head speed of 10 inches per minute after maintaining the sample under TAPPI conditions for 4 hours before testing. A 50 Newton maximum load cell is utilized in the tensile test instrument.

Machine Direction Slope or Cross-Machine Direction Slope is a measure of the stiffness of a sheet and is also referred to as elastic modulus (in kilogram-force). The slope of a sample in the machine direction or the cross-machine direction is a measure of the slope of a stress-strain curve of a sheet taken during a test of tensile testing (see geometric mean tensile strength definition above) and is expressed in units of kilograms of force. In particular, the slope is taken as the least squares fit of the data between stress values of 70 grams of force and 157 grams of force.

Machine Direction Stretch and Cross Machine Direction Stretch is the amount of stretch the sample undergoes prior to failure when placed in a tensile tester as described above with respect to slope and geometric mean tensile strength. Stretch is measured in percent.

Caliper was measured in microns using the Emveco Caliper Tester, which measures caliper under a load of 2 kPa.

Handsheets were formed from a fiber furnish containing 65% by weight eucalyptus fibers and 35% by weight northern softwood kraft fibers. Each of the handsheets had a basis weight of about 20 gsm.

Each of the handsheets were dewatered to approximately 60% consistency using a Carver press. Blotter papers were placed on the top and bottom of the press during the dewatering process.

Five of the handsheets were then deflected once on a fabric. The fabric used was manufactured by Voith Fabrics under the trade name 44MST and was a 42×36 fabric with 0.35 mm diameter machine direction strands and 0.41 mm cross machine direction strands. To carry out the deflection, the handsheet was placed on the fabric. A nozzle from a shop vac was placed below the fabric. The sheet, while on the fabric, was then passed over the nozzle while the shop vac was operating. It is believed that the shop vac created pressure in an amount of approximately 30 inches of water.

Five other samples of the handsheets were then deflected three times using a similar procedure. In particular, the handsheets were deflected twice on one side of the sheet and once on an opposite side of the sheet. The two deflections carried out on the same side of the sheet were done using the fabric described above. The opposite side of the sheet was deflected on a 44GST fabric manufactured by Voith Fabrics and was a 42×34 fabric, with 0.35 mm diameter machine direction strands and 0.41 mm cross direction strands.

The following results were obtained:

Control - One Deflection

| Sample No. | Consistency | Caliper (microns) | MD Tensile | CD Tensile | GMT | MD-stretch | CD-stretch | MD-slope | CD-slope |
|---|---|---|---|---|---|---|---|---|---|
| Control 1 | 67 | 109 | 8.34 | 5.86 | 6.99 | 1.31 | 1.67 | 48.46 | 23.01 |
| Control 2 | 61 | 157 | 6.89 | 7.25 | 7.07 | 1.46 | 1.62 | 33.25 | 34.22 |
| Control 3 | 60 | 116 | 7.80 | 7.09 | 7.44 | 1.51 | 1.30 | 28.72 | 36.68 |
| Control 4 | 62 | 110 | 8.96 | 6.70 | 7.75 | 1.32 | 1.27 | 44.16 | 35.14 |
| Control 5 | 62 | 114 | 8.88 | 8.04 | 8.45 | 1.30 | 1.87 | 46.23 | 28.46 |
| Average | 62.4 | 121 | 8.2 | 7.0 | 7.5 | | | | |

Handsheets Deflected Three Times

| Sample No. | Consistency | Caliper (microns) | MD Tensile | CD Tensile | GMT | MD-stretch | CD-stretch | MD-slope | CD-slope |
|---|---|---|---|---|---|---|---|---|---|
| 1 | 61 | 113 | 6.60 | 6.38 | 6.49 | 1.32 | 0.99 | 36.19 | 44.18 |
| 2 | 64 | 120 | 8.13 | 5.72 | 6.82 | 1.08 | 1.21 | 49.51 | 29.50 |
| 3 | 63 | 187 | 8.36 | 6.09 | 7.14 | 1.44 | 1.15 | 46.54 | 38.24 |
| 4 | 61 | 173 | 6.75 | 7.55 | 7.14 | 1.56 | 1.15 | 29.88 | 47.01 |
| 5 | 66 | 127 | 7.16 | 7.72 | 7.43 | 1.91 | 1.21 | 23.93 | 44.30 |
| Average | 63 | 144 | 7.4 | 6.7 | 7.0 | | | | |

As shown above, the handsheets that were deflected multiple times showed an increase in caliper and a decrease in geometric mean tensile strength, indicating a decrease in stiffness.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A method of producing a tissue web comprising:

conveying a tissue web around a deflection roll, the tissue web having a consistency of less than about 70%, the web being located between a first transfer fabric and a second transfer fabric when traveling around the roll, the deflection roll including at least one gas receiving zone and at least one gas emitting zone, the tissue web being deflected against the first transfer fabric and against the second transfer fabric when conveyed around the deflection roll; and thereafter drying the web to a final dryness.

2. A method as defined in claim 1, wherein the tissue web is formed from an aqueous suspension of papermaking fibers.

3. A method as defined in claim 2, wherein the tissue web is partially dewatered prior to being conveyed around the deflection roll.

4. A method as defined in claim 3, wherein the tissue web has a consistency of from about 40% to about 60% when conveyed around the deflection roll.

5. A method as defined in claim 3, wherein the tissue web is dewatered by being fed through a nip defined by a pair of opposing press rolls.

6. A method as defined in claim 3, wherein the web is dewatered by being fed through a through-air dryer.

7. A method as defined in claim 1, wherein the first transfer fabric and the second transfer fabric are wrapped around the deflection roll at least 30 degrees.

8. A method as defined in claim 1, wherein the second transfer fabric comprises a fabric sleeve wrapped around the deflection roll.

9. A method as defined in claim 8, wherein the tissue web is molded against the second transfer fabric when passed over the gas receiving zone, and wherein the tissue web is molded against the first transfer fabric when passed over the gas emitting zone.

10. A method as defined in claim 1, wherein the deflection roll includes at least two gas receiving zones, the gas emitting zone being located in between the two gas receiving zones.

11. A method as define in claim 1, wherein the deflection roll includes at least two gas emitting zones, the gas receiving zone being positioned in between the two gas emitting zones.

12. A method as defined in claim 1, wherein the web is dried to a final dryness by transferring the web to a drying cylinder and creping the web from the cylinder.

13. A method as defined in claim 1, wherein the final dried web has a basis weight from about 6 gsm to about 45 gsm.

14. A method as defined in claim 1, wherein the tissue web is deflected against the first transfer fabric and against the second transfer fabric with a force sufficient to mold the tissue web against the fabrics.

* * * * *